US011105166B2

(12) United States Patent
Yuan et al.

(10) Patent No.: US 11,105,166 B2
(45) Date of Patent: Aug. 31, 2021

(54) BUOYANCY ASSIST TOOL WITH FLOATING PISTON

(71) Applicant: Halliburton Energy Services, Inc., Houston, TX (US)

(72) Inventors: Min Mark Yuan, Katy, TX (US); Lonnie Carl Helms, Humble, TX (US); Mayur Narain Ahuja, Friendswood, TX (US); Ishwar Dilip Patil, Spring, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/552,444

(22) Filed: Aug. 27, 2019

(65) Prior Publication Data

US 2021/0062598 A1 Mar. 4, 2021

(51) Int. Cl.

| | |
|---|---|
| ***E21B 29/02*** | (2006.01) |
| ***E21B 23/04*** | (2006.01) |
| ***E21B 34/06*** | (2006.01) |
| ***E21B 23/06*** | (2006.01) |
| *E21B 33/134* | (2006.01) |
| *E21B 33/12* | (2006.01) |

(52) U.S. Cl.

CPC ..... *E21B 23/04* (2013.01); *E21B 23/065* (2013.01); *E21B 34/063* (2013.01); *E21B 33/12* (2013.01); *E21B 33/134* (2013.01)

(58) Field of Classification Search

CPC ..... E21B 29/02; E21B 34/063; E21B 33/134

See application file for complete search history.

(56) References Cited

U.S. PATENT DOCUMENTS

| | | | | |
|---|---|---|---|---|
| 3,463,351 | A | 8/1969 | Mills | |
| 3,779,263 | A | 12/1973 | Edwards et al. | |
| 3,980,134 | A * | 9/1976 | Amancharla | E21B 33/1294 166/133 |
| 4,457,376 | A | 7/1984 | Carmody et al. | |
| 5,150,756 | A | 9/1992 | Hassanzadeh | |
| 5,479,986 | A | 1/1996 | Gano et al. | |
| 5,765,641 | A | 6/1998 | Shy et al. | |
| 5,826,661 | A | 10/1998 | Parker et al. | |

(Continued)

FOREIGN PATENT DOCUMENTS

| | | |
|---|---|---|
| EP | 0566290 A1 | 10/1993 |
| EP | 0681087 B1 | 9/2000 |

(Continued)

OTHER PUBLICATIONS

International Search Report and Written Opinion dated May 26, 2020, issued in PCT Application No. PCT/US2019/059757.

(Continued)

*Primary Examiner* — Cathleen R Hutchins
(74) *Attorney, Agent, or Firm* — McAfee & Taft

(57) ABSTRACT

A downhole apparatus comprises a casing string with a fluid barrier connected in the casing string. A degradable plug is positioned in the casing string above the fluid barrier. The degradable plug and fluid barrier define upper and lower ends of a buoyancy chamber in the casing string. The degradable plug may be degraded to leave an open bore through the casing string after the casing string is lowered into a wellbore.

15 Claims, 3 Drawing Sheets

(56) References Cited

U.S. PATENT DOCUMENTS

| | | | | |
|---|---|---|---|---|
| 6,026,903 | A | 2/2000 | Shy et al. | |
| 6,076,600 | A | 6/2000 | Vick, Jr. et al. | |
| 6,161,622 | A * | 12/2000 | Robb | E21B 23/00 166/292 |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1* | 3/2008 | Buyers | E21B 33/1208 166/188 |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1* | 5/2012 | Sherman | E21B 34/063 166/297 |
| 2014/0174757 | A1 | 6/2014 | Fripp et al. | |
| 2014/0216756 | A1 | 8/2014 | Getzlaf et al. | |
| 2014/0224505 | A1 | 8/2014 | Ramon | |
| 2014/0338923 | A1* | 11/2014 | Fripp | E21B 33/1208 166/376 |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0219200 | A1 | 8/2018 | Albukrek et al. | |
| 2018/0262127 | A1 | 9/2018 | Gooneratne et al. | |
| 2018/0371869 | A1* | 12/2018 | Kellner | E21B 21/103 |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 23, 2019, issued in PCT Application No. PCT/US2018/064085.
International Search Report and Written Opinion dated Aug. 14, 2019, issued in PCT Application No. PCT/US2018/064051.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.

* cited by examiner

BUOYANCY ASSIST TOOL WITH FLOATING PISTON

BACKGROUND

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

DESCRIPTION

Figure 1:
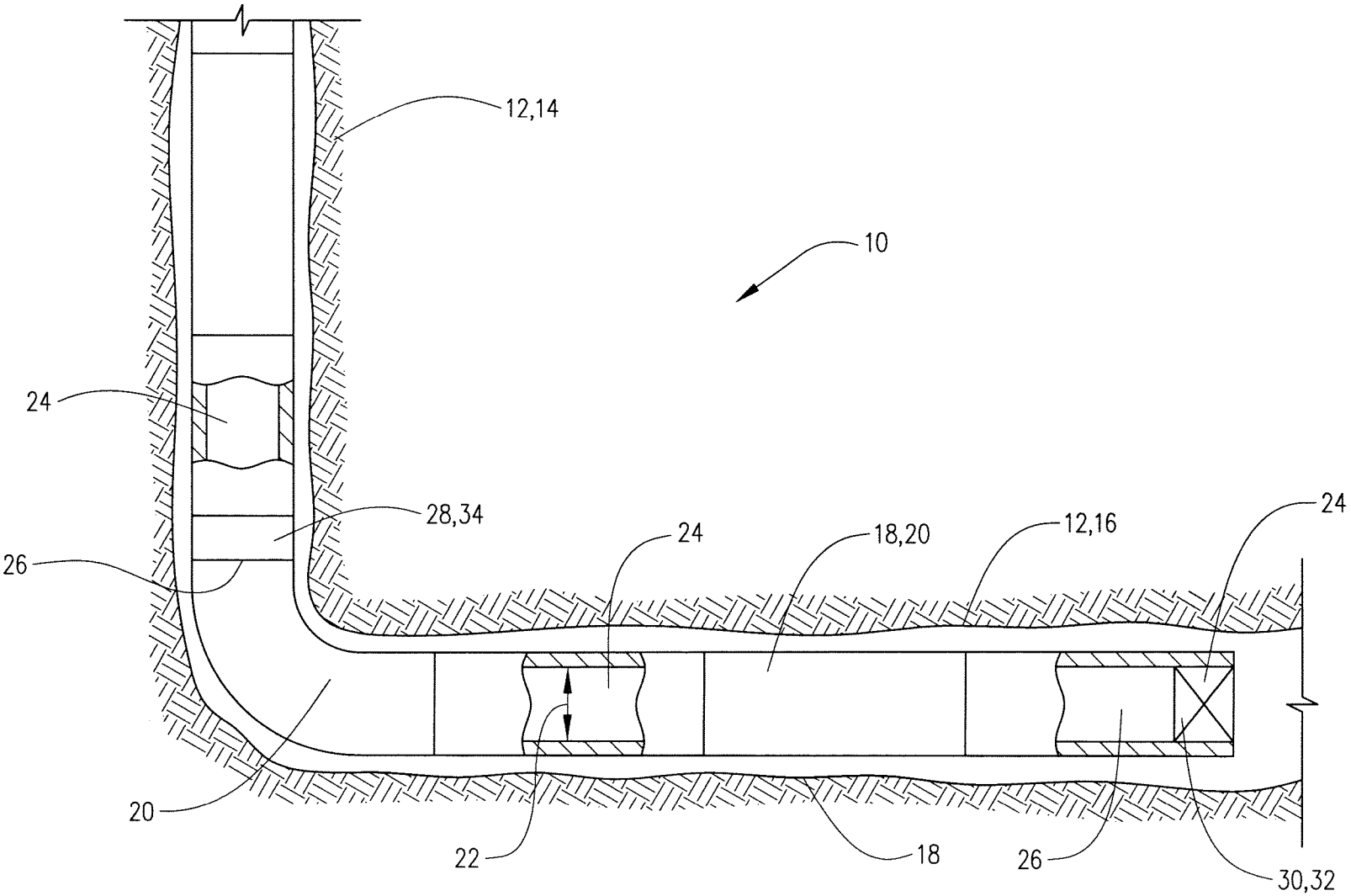
FIG. 1 is a schematic view of an exemplary well bore with a well casing including a buoyancy chamber therein.
Figure 2:
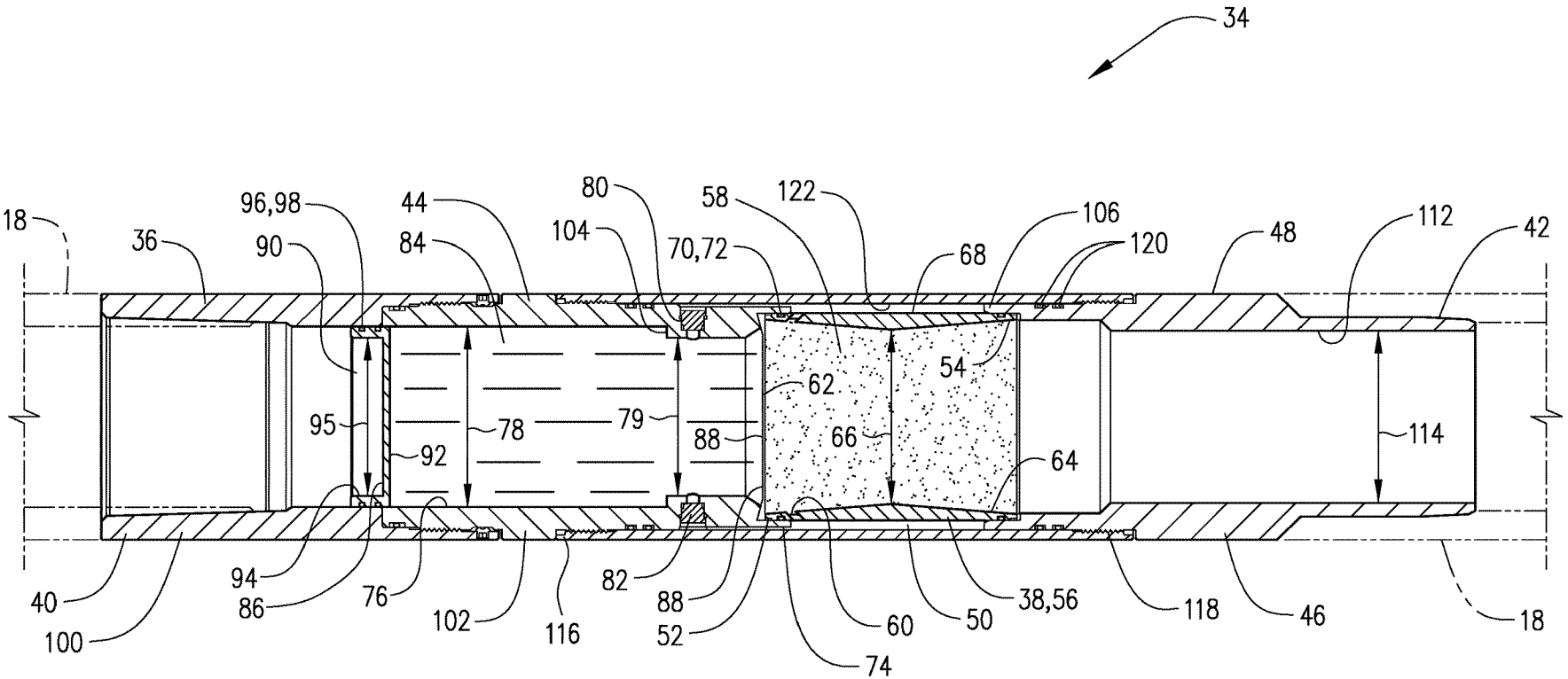
FIG. 2 is a cross section of a buoyancy assist tool of the current disclosure.
Figure 3:
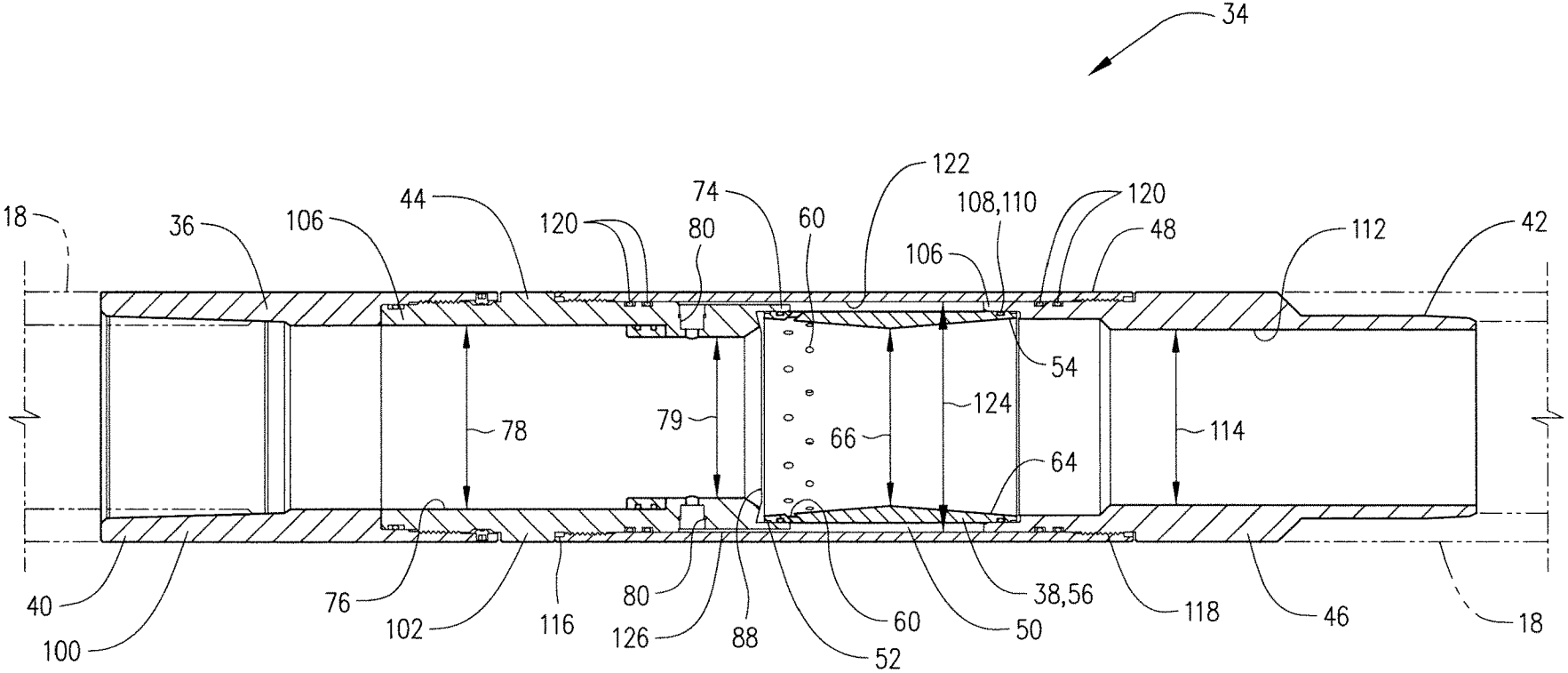
FIG. 3 is a cross section of a buoyancy assist tool of FIG. 2 after the plug has degraded and removed from the buoyancy assist tool.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these is used is a factor of the well conditions and the amount of buoyancy desired.

Lower boundary 30 may comprise a float device such as a float shoe or float collar 32. As is known, such float devices will generally allow fluid flow downwardly therethrough but will prevent flow upwardly into the casing. The float devices are generally a one-way check valve. The float device 30 is thus a fluid barrier that will be configured such that it will hold the buoyant fluid in the buoyancy chamber 26 until additional pressure is applied to release the buoyancy fluid from the buoyancy chamber. The upper boundary 28 is defined by a buoyancy assist tool as described herein.

Buoyancy assist tool 34 includes an outer case 36 that is connectable in casing string 18. Buoyancy assist tool 34 comprises a plug assembly 38 that is connected to and positioned in outer case 36. Buoyancy assist tool 34 has upper end 40 and lower end 42. Buoyancy assist tool 34 is connectable in the casing string at the upper and lower ends 40 and 42 thereof and forms a part of the casing string 18 lowered into well bore 12.

Outer case 36 comprises an upper outer case 44 and a lower outer case 46. A connecting shield 48 is connected to and extends between upper outer case 44 and lower outer case 46. Outer case 36 and plug assembly 38 define an annular space 50 therebetween. Annular space 50 in the embodiment shown is defined by and between connecting sleeve 48 and plug assembly 38.

Plug assembly 38 has upper end 52 and lower end 54. Plug assembly 38 is connected to upper outer case 44 at the upper end 52 thereof and to lower outer case 46 at the lower end 54 thereof. The plug assembly may be threadedly connected or connected by other means known in the art. Plug assembly 38 may comprise a plug housing 56 with upper and lower ends 52 and 54 which are the upper and lower ends of the plug assembly 38. A degradable plug or degradable core 58 is fixed in housing 56. The degradable core may be a matrix of sand and salt but can be other degradable substances that can be degraded with fluids or other means once the casing string 18 is lowered into the wellbore to a desired location in the well. Plug housing 56 has a plurality of housing ports 60 defined through the wall thereof. Housing ports 60 communicate the annular space 50 with the degradable plug or core 58 so that fluid passing therethrough can contact degradable plug 58 and can degrade the plug to remove it from plug housing 56 to create a full bore flow path therethrough.

Buoyancy assist tool 34 may include a non-permeable cap 62 positioned across upper end 52 of plug assembly 38. Non-permeable cap 62 may be comprised of a resin or a rubber material or other non-permeable material that will prevent fluid thereabove from contacting the degradable plug at the upper end of the plug assembly 38 prior to the time casing string 18 is placed at the desired location in wellbore 12. The non-permeable cap 62 will be configured such that upon degradation of the plug 58 the cap will be easily ruptured by fluid flowing through the casing string 18, including outer case 36.

Plug housing 56 has an inner surface 64 defining a diameter 66 and has an outer surface 68. In the embodiment described diameter 66 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Upper end 40 of buoyancy assist tool 34 is likewise the upper end of upper outer case 44. Upper outer case 44 has a lower end 74. Plug assembly 38 is connected at its upper end 52 to the lower end 74 of upper outer case 44. Outer surface 68 of plug housing 56 may have a groove 70 with an O-ring seal 72 therein to sealingly engage an inner surface of upper outer case 44. Upper outer case 44 has inner surface 76 which defines a first inner diameter 78 and a second inner diameter 79 that is a minimum inner diameter of upper outer case 44. In the embodiment shown upper outer case 44 has a port 80 therethrough. Inner diameter 79 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

A rupture disk or other rupturable membrane 82 is positioned in port 80 in upper outer case 44. The downhole apparatus 10 may include a plurality of ports 80 and rupture disks 82, and in the embodiment disclosed has two ports 80 with rupture disks 82 therein. Rupture disks 82 will prevent flow through port 80 until a desired or pre-determined pressure is reached in casing string 18. Upon reaching the pre-determined pressure the rupture disk 82 will rupture and fluid will be communicated from a fluid chamber 84 above the degradable plug 58 through port 80 into annular space 50. Fluid will pass from annular space 50 through housing ports 60 and will contact the degradable plug 58. The fluid passing therethrough may be referred to as a degrading fluid. The degrading fluid may be any fluid utilized to degrade the degradable plug and may be water or other degrading fluid.

Fluid chamber 84 has lower end 88 and upper end 86. Non-permeable cap 62 prevents the fluid in fluid chamber 84 from contacting degradable plug 58 prior to rupturing of rupture disk 82. A floating piston 90 is slidably disposed in outer case 36, and in the embodiment described in upper outer case 44. Outer case 36 forms a part of casing string 18 so that floating piston 90 is slidably disposed in casing string 18. Floating piston 90 has a floor 92 and a wall, which is a generally cylindrical wall 94 extending upwardly therefrom. Wall 94 defines an inner diameter 95, and has a pair of grooves 96 in an outer surface thereof with seals 98 therein. Floating piston 90 is thus sealingly and slidably disposed in outer case 36. Piston 90 is at the upper end 88 of fluid chamber 84, and separates the fluid in the casing string 18 thereabove from the fluid in the fluid chamber 84.

Upper outer case 44 may be a two-piece outer case comprising an upper portion 100 that is threadedly and sealingly connected to lower portion 102. Lower portion 102 connects to plug assembly 38 as shown in the figures. Upper outer case 44 defines an upward facing shoulder 104 thereon, which, as will be explained in detail below, will be engaged by floating piston 90 when plug 58 is degraded. Upward facing shoulder 104 is defined by first and second inner diameters 78 and 79 of upper outer case 44. There are certain formations in which it is not desirable to pump water. In those instances oil or another fluid other than water may be utilized to fracture or otherwise treat the formation. Where, for example, water is the degrading fluid, but not the treatment fluid, water will be contained in the fluid chamber 84 such that upon reaching the appropriate position in the well oil or other fluid may be pumped through the casing string 18 so that the water in fluid chamber 84 will contact the degradable plug 58 as further described herein. The water in fluid chamber 84 passes into and from annular space 50 through ports 60 in housing plug 56 and will contact the degradable plug 58 until it is degraded or dissolved.

Lower outer case 46 has upper end 106 and a lower end which is the lower end 42 of buoyancy assist tool 34. Upper end 106 of lower outer case 44 is connected to lower end 54 of plug assembly 38. Outer surface 68 of plug housing 56 may have a groove 108 with an O-ring seal 110 therein to sealingly engage lower outer case 44. Lower outer case 44 has inner surface 112 defining an inner diameter 114. Inner diameter 114 is a diameter that is no smaller than an inner diameter of casing string 18 such that upon the degradation of plug 58 buoyancy assist tool 34 provides no greater restriction to the passage of well tools therethrough than that which already exists as a result of the inner diameter of the casing string 18.

Connecting sleeve 48 has upper end 116 and lower end 118. Connecting sleeve 48 is connected at its upper end 116 to an outer surface of upper outer case 44 and is connected at its lower end 118 to an outer surface of lower outer case 46. O-ring seals 120 may be positioned in grooves in the outer surfaces of the upper and lower outer cases 44 and 46 respectively to sealingly engage an inner surface 122 of connecting shield 48. Inner surface 122 of connecting shield 44 defines an inner diameter 124. An annular passageway 126 is defined by and between upper outer case 44 and connecting shield 48. Annular passageway 126 communicates fluid delivered through port 80 into annular space 50. Fluid is communicated through ports 60 so that it will contact degradable plug 58 to dissolve or degrade the plug.

In operation casing string 18 is lowered into wellbore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the casing string 18 has reached the desired position in the wellbore, pressure is increased and fluid pumped through the casing string 18. Floating piston 90 will separate the fluid in the casing string 18 thereabove from the degrading fluid in fluid chamber 84. When the pressure reaches a predetermined pressure in the casing, rupture disk 82 will rupture. The fluid above the sliding piston will urge piston 90 downwardly, and piston 90 will urge the degrading fluid through port 80 and annular passageway 126 into annular space 50. Piston 90 may be configured such that the inner diameter 95 is equal to or grater than the diameter 79.

Degrading fluid will pass from annular space 50 through ports 60 and will contact the degradable plug 58. A sufficient quantity of the degrading fluid will be utilized to degrade degradable plug 58 so that it will be completely removed from plug housing 56 by the degrading fluid and/or the fluid passing downward through casing string 18 which will urge any remaining pieces of the degradable plug 58 from the outer case 36. Typically when the degradable plug begins to degrade, the pressure of the fluid thereabove will cause the plug 58 to break up and pass downward through the casing where it will be completely degraded, or will pass through the float shoe, float collar or other valve at the end of the casing string 18. The piston 90 will engage shoulder 104, and fluid pressure in the casing and/or the impact upon engaging shoulder 104 will cause piston 90 to break up into pieces and pass downward through casing string 18. Piston 90 may be configured such that inner diameter 95 is equivalent to or greater than the diameter 66 and in any event is such that it will not provide any restriction on the passage of tools therethrough than does the casing string thereabove. As a result, the piston 90 may be configured so that the wall does not break apart, and only the floor 92 breaks into pieces. Sliding piston 90 is made of a material that will break under pressure, or as a result of an impact, and may be for example, a thermoplastic or ceramic piston. Piston 90 may also be for example tempered glass.

The choice of degrading fluid will be dependent on the plug material, but in many cases water will be used to degrade a plug formed of a sand and salt matrix. Once the degradable plug 58 is dissolved or degraded and moved out of plug housing 56 service tools may be passed through plug assembly 38, and more particularly through plug housing 56. As described herein, buoyancy assist tool 34 provides no size restriction on the tools that can be passed therethrough that does not already exist due to the size of the inner diameter of casing 18. Thus, in the embodiments described inner diameters 66, 79 and 114 may be generally the same as or larger than the minimum inner diameter of casing string 18 thereabove. The inner diameter 95 defined by cylindrical wall 94 of sliding piston 90 can be likewise. However, if diameter 95 is smaller the wall 94 will shatter and fall through casing string 18 and will not create a restriction to the passage of tools as described herein.

The current disclosure is directed to a downhole apparatus comprising a casing string and a fluid barrier connected in the casing string. A degradable plug is positioned in the casing string above the fluid barrier and the degradable plug and fluid barrier comprise upper and lower ends of a buoyancy chamber in the casing string. The downhole apparatus has a non-permeable cap covering an upper end of the degradable plug.

The downhole apparatus may further comprise an outer case connected in the casing string with the degradable plug positioned in the outer case. The outer case and the degradable plug define an annular space configured to receive a degrading fluid. The downhole apparatus comprises a plug housing with the degradable plug fixed in the plug housing. The plug housing defines ports through a wall thereof configured to communicate fluid from the annular space to the degradable plug.

The outer case may comprise an upper outer case configured to connect in the casing string and a lower outer case configured to connect in the casing string. A connecting sleeve is connected at one end to the upper outer case and at a second end to the lower outer case. The annular space may be defined between the connecting sleeve and the degradable plug. The outer case of the downhole apparatus has a port defined therein configured to communicate the degrading fluid to the annular space.

The outer case defines a fluid chamber containing the degrading fluid. A sliding piston movable relative to the casing is disposed in the outer case and is positioned at an upper end of the fluid chamber. The non-permeable cap at the upper end of the degradable plug will prevent the degrading fluid in the fluid chamber from prematurely contacting the degrading plug. The sliding piston is a frangible piston, and upon degradation of the degradable plug, at least a portion of the frangible piston will shatter, and the pieces thereof will fall downward in the casing string, so that an open bore for the passage of tools is defined through the outer case. In one embodiment the entire sliding piston shatters.

The downhole apparatus comprises a buoyancy assist tool. The buoyancy assist tool comprises a plug assembly. The plug assembly comprises a plug housing with a degradable plug fixed therein. The plug assembly is connectable in a casing string, and in one embodiment is connected in an outer case that is connectable at upper and lower ends thereof in a casing string. The buoyancy assist tool in one embodiment has an upper outer case connected at a lower end to the plug assembly and is configured to connect in a casing string at an upper end thereof. A lower outer case is connected at an upper end to the plug assembly and a connecting sleeve connecting the upper and lower outer cases. The connecting sleeve and plug assembly define an annular space therebetween configured to receive a plug degrading fluid.

The plug housing of the buoyancy assist tool defines a plurality of ports therein configured to communicate the degrading fluid from the annular space with the degradable plug. The upper outer case defines a port in a wall thereof, the port having a rupturable plug, or rupture disk therein. The port is configured to communicate degrading fluid into the annular space when the plug ruptures. The rupture disk ruptures when a predetermined pressure in the casing string is reached A fluid chamber is defined in the outer case above the degradable plug, and may be separated from the degradable plug by a non-permeable cap across the upper end of the degradable plug. A sliding piston is disposed in the outer case and defines an upper end of the fluid chamber. The sliding piston comprises a generally circular floor and a cylindrical wall extending therefrom. The sliding piston slidingly and sealingly engages the outer case.

The sliding piston will push downwardly on the fluid in the fluid chamber as a result of fluid thereabove in the casing pushing on the sliding piston. The rupture disk will rupture when the pressure applied in the casing string reaches a predetermined pressure. The sliding piston will then move downwardly and will push degrading fluid through the port in the outer case and into the annular space between the plug housing and the outer case. The degrading fluid will be communicated to the degradable plug though ports, which in one embodiment are upwardly slanted ports, in the plug housing. Once the degradable plug is removed from the plug housing, the sliding piston will engage an upwardly facing shoulder in the plug housing, and will either shatter as a result of pressure in the casing and/or impact on the shoulder. In one embodiment the wall of the piston will not shatter but will remain in the outer case.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing string;

an outer case connected at upper and lower ends thereof in the casing string;

a degradable plug positioned in the outer case to block flow therethrough, the outer case and degradable plug defining an annular space therebetween;

a fluid chamber filled with a degrading fluid above the degradable plug;

a sliding piston positioned in the casing string defining an upper end of the fluid chamber and movable relative to the casing; and a rupturable plug positioned in a port defined in the outer case, the sliding piston movable downward in the casing to rupture the plug and urge the degrading fluid into the annular space from the fluid chamber upon the application of a predetermined pressure in the casing.

2. The downhole apparatus of claim 1 further comprising a fluid barrier connected in the casing below the degradable plug, the fluid barrier and the degradable plug defining a buoyancy chamber therebetween.

3. The downhole apparatus of claim 1, the piston configured to separate a fluid thereabove from the degrading fluid in the fluid chamber.

4. The downhole apparatus of claim 1 further comprising a plug housing connected in the outer case, the degradable plug fixed in the plug housing and the plug housing having a plurality of upwardly slanted ports defined therethrough configured to communicate fluid from the annular space to the degradable plug.

5. The downhole apparatus of claim 1, the sliding piston comprising a frangible sliding piston, the degradable plug being completely removable such that the outer case defines an open bore therethrough.

6. A downhole apparatus comprising:

a plug housing;

a degradable plug fixed in the plug housing;

an outer case connectable at upper and lower ends thereof in a casing string, the outer case and the plug housing defining an annular space therebetween;

a sliding piston disposed in the outer case, the sliding piston and degradable plug defining a fluid chamber therebetween with a degrading fluid therein, and a rupturable plug positioned in a port defined in the outer case, the rupturable plug configured to rupture to permit flow through the port into the annular space at a predetermined pressure.

7. The downhole apparatus of claim 6, the sliding piston configured to slide downwardly in the outer case and urge the degrading fluid through the port.

8. The downhole apparatus of claim 7, the plug housing defining a plurality of upwardly slanted ports therethrough positioned to communicate degrading fluid from the annular space to the degradable plug.

9. The downhole apparatus of claim 7, the sliding piston comprising a frangible piston configured to shatter and pass downward in the outer case upon degradation of the degradable plug.

10. The downhole apparatus of claim 9 the frangible sliding piston being comprised of a material selected from the group consisting of ceramic and thermoplastic materials.

11. A downhole apparatus comprising:

a plurality of casing joints defining a casing string;

an outer case connected in and forming a part of the casing string;

a degradable plug fixed in a plug housing connected in the outer case, the plug housing and outer case defining an annular space therebetween;

a flow barrier connected in the casing string below the degradable plug, the flow barrier and the degradable plug defining a buoyancy chamber;

a sliding piston positioned in the outer case above the degradable plug, the sliding piston and degradable plug defining a fluid chamber therebetween, the fluid chamber containing a degrading fluid; and a rupturable disk positioned in a port defined in the outer case, the sliding piston configured to rupture the disk at a predetermined pressure and push fluid through the port into the annular space.

12. The downhole apparatus of claim 11 the sliding piston comprising a frangible piston.

13. The downhole apparatus of claim 12, further comprising a non-permeable cap separating the degrading fluid from the degradable plug.

14. The downhole apparatus of claim 12, the sliding piston comprising tempered glass.

15. The downhole apparatus of claim 12, the outer case defining a shoulder thereon, the sliding piston configured to engage the shoulder in the outer case after the degradable plug has degraded.

* * * * *